US005323970A

United States Patent [19]

Tsutsui et al.

[11] Patent Number: 5,323,970

[45] Date of Patent: Jun. 28, 1994

[54] METHOD FOR MAKING A POWDER COATING

[75] Inventors: Koichi Tsutsui, Tsuzuki; Akimitsu Uenaka, Suita; Zenichi Yasuda, Ibaraki, all of Japan

[73] Assignee: Nippon Paint Co., Ltd., Osaka, Japan

[21] Appl. No.: 827,120

[22] Filed: Jan. 28, 1992

[30] Foreign Application Priority Data

Jan. 30, 1991 [JP] Japan ..... 3-031849
Jan. 30, 1991 [JP] Japan ..... 3-031850

[51] Int. Cl.[5] ..... B02C 23/18
[52] U.S. Cl. ..... 241/3; 241/23
[58] Field of Search ..... 241/23, 3, 101.8, 261.1, 241/260

[56] References Cited

U.S. PATENT DOCUMENTS

| | | | |
|---|---|---|---|
| 233,839 | 11/1880 | Dunn et al. | 241/261.1 |
| 2,556,641 | 6/1951 | Bakewell | 241/260 X |
| 3,880,360 | 4/1975 | Peng et al. | 241/3 |
| 3,941,315 | 3/1976 | Gribble et al. | 241/3 |
| 4,562,972 | 1/1986 | Hagiwara et al. | 241/260 |
| 5,081,072 | 1/1992 | Hosokawa et al. | 241/3 X |

FOREIGN PATENT DOCUMENTS 61-36463 8/1986 Japan .

*Primary Examiner*—Rinaldi Rada
*Attorney, Agent, or Firm*—Vineet Kohli; Thomas R. Morrison

[57] ABSTRACT

There is obtained with greater efficiency a powder coating having an average particle diameter smaller and a particle size distribution range narrower than those currently made by conventional methods. The method to obtain the powder coating comprising; introducing a solid mixture of coating materials between a rotor and a stator; the rotor being supported in such a manner as to be rotating round the shaft center and, on its periphery, being arranged with multiple convex lines extending in a direction of the shaft and being lined up along the periphery; the stator having a cylindric rotor-opposite face arranged with a certain interspace between this face and the rotor periphery and having, on the rotor-opposite face, multiple convex lines extending in the direction of the shaft and being lined up along the circumference, wherein the rotor-opposite face is arranged in such a manner as to be capable of opening in order to expose the rotor periphery; and then pulverizing finer said mixture by said rotating rotor and said stator.

8 Claims, 7 Drawing Sheets

| Name of Powder | Test No. | Average Particle Diameter | Magnification | 10 μm |
|---|---|---|---|---|
| | B-5 1 Pass | μm | x 2000 | |

| Name of Powder | Test No. | Average Particle Diameter | Magnification | 10 μm |
|---|---|---|---|---|
| | B-9 3 Pass | μm | x 2000 | |

METHOD FOR MAKING A POWDER COATING

BACKGROUND OF THE INVENTION

The present invention relates to a method for making a powder coating.

The powder coating is usually produced by passing it through the following processes in sequence: 1) a process for premixing materials for coating under dry conditions, 2) a process for melting and kneading the materials, 3) a process for pulverizing it, and 4) a process for classifying it.

The performance of a coated film made by using a powder coating, in particular, the presence or absence of uneven irregularities on the coated film as well as the gloss, is affected by the average particle diameter and particle size distribution range of the powder coating particles. That is, as the average particle diameter becomes smaller and/or the particle size distribution range becomes narrower, the surface smoothness becomes better. As a result, the irregularities on the coated film disappear and the gloss is improved.

To make the average particle diameter of a powder coating smaller, it is preferable to pulverize the powder coating finer. But the average particle diameter is from about 20 to 30 μm using conventional procedures, such as, for example pulverizing particles by a hammer mill.

To make the particle size distribution range narrower, it is preferable to classify the powder coating. But there occurs a problem that the efficiency of making a powder coating decreases greatly due to this classification.

OBJECTS AND SUMMARY OF THE INVENTION

Accordingly, it is a general object of the present invention to provide a method for making efficiently a powder coating with an average particle diameter smaller than the powder coating currently made by conventional methods, and having a narrower range of particle size distribution.

To attain the above objective, the present invention provides a method for making a powder coating, which comprises introducing a solid mixture of coating materials between a rotor and a stator, pulverizing the mixture finer by rotating the rotor to obtain a powder coating, wherein the rotor is supported so as to rotate around the shaft center. On this rotor, there are multiple convex lines that extend in the direction of the shaft and are arranged to line up along the periphery. The stator has a cylindric inner periphery opposite the periphery of the rotor with a certain interspace between this face and the rotor periphery. It also has, on the inner periphery multiple convex teeth that extend in the direction of the shaft and are lined up along the inner circumference. The inner periphery is capable of opening in order to expose the rotor periphery.

According to the present invention, a pulverizer having a rotor and a stator as mentioned above (hereinafter, referred to as "pulverizer A") is used. The aforementioned mixture is pulverized between the rotor and the stator.

When the mixture is pulverized, the rotor is rotated and an air current having a temperature of (Tg-5)°C. or lower (Tg is a glass transition temperature of the mixture) may be supplied between the rotating rotor and the stator.

The air current temperature may be in the range of (Tg-5)° to (Tg-10)°C.

Between the rotor and the stator, as described above, a solid mixture of coating materials is introduced and, when the rotor is rotated, a whirlpool of air is created between the rotor and the stator, thereby causing particles of the mixture to collide with each other and pulverize. As a result, a powder coating having a small average particle diameter and narrower particle size distribution is obtained. Thus, the need for classifying becomes unnecessary and efficiency is elevated. Also, since it is possible to open the stator in order to expose the rotor periphery face, it is easier to clean and examine the equipment.

In pulverizing, if an air current having a temperature of (Tg-5)°C. or lower is supplied, the pulverizing can be carried out with higher efficiency.

If the air current temperature is in a range of (Tg-5)° to (Tg-10)°C., rounder particles can be obtained.

According to this invention, the method for making a powder coating results in the powder coating having an average particle diameter smaller than that currently derived from conventional methods such as a method by a hammer mill, etc. In addition, it has a narrower particle size distribution range being with greater efficiency. In addition, cleaning the pulverizing apparatus is easy.

In this invention, if the air current temperature is set at a temperature of (Tg-5)°C. or lower during pulverizing, attachment of a coating to the pulverizing apparatus is minimal and cleaning is easy.

In this invention, if the air current temperature during pulverizing is set at a temperature in a range of (Tg-5)° to (Tg-10)°C., the coating particles become rounder compared with those obtained by conventional methods, so that a powder coating which shows hardness in blocking and easiness in handling is obtained.

The powder coating is usually produced by passing it through the following processes in sequence: 1) a process for premixing materials for coating under dry conditions without using solvents, 2) a process for melting and kneading the materials, 3) a process for pulverizing it, and 4) a process for classifying it.

In producing the coating, the color match is important. However, in conventional methods for producing a powder coating, the processes of making a powder coating, coating it, and baking it are repeated many times in stages. Usually additional pigment is added until the color required of a coated film is matched. Thus, there is a problem in that color matching takes a long time and materials are wasted.

To shorten the time for color matching, it is preferable to mix the materials under wet conditions. That is, if wet mixing is carried out, followed by coating and drying of the mixture, a coated film is formed, so that confirmation of the color required can be carried out by this film. Therefore, there is almost no waste of materials.

However, if wet mixing is adopted, a new problem is created, which involves inefficiency during the drying process and difficulties in the pulverizing process.

Accordingly, it is an object of the present invention to provide a method for making a powder coating which makes color matching possible in a short time, intends to increase efficiency during the drying process, and makes the pulverization facile.

To solve the above object, there is provided a method for making a powder coating which comprises drying a dispersed paste, made by mixing coating materials in the presence of a solvent, and pulverizing the dried product from the paste. The present invention provides a method for making a powder coating being characterized in that:

the drying process of said dispersed paste comprises using a dispersed paste having a solid portion concentration of 60 to 80% by weight (hereinafter, the solid portion concentration is referred to as "NV"), forming the paste into a film of thickness T on a conveyor belt, and drying the paste at its bottom side at a pressure of 10 Torr or less from a heating means located under the conveyor belt, whereby the dried product having a NV of 95% or more by weight, high volume, and a density of 0.4 to 0.6 $g/cm^3$ is obtained.

If the heat drying is carried out under a reduced pressure keeping the dispersed paste in a one side-opened condition, a product having high volume is easily obtainable. The high volume product can be easily pulverized in the subsequent process.

If the NV of a dispersed paste is lower than the above defined range, the drying time becomes longer and heat deterioration occurs. On the other hand, if the NV is higher than the range, then high volume product can not be obtained.

In drying, preferably the thickness of a dispersed paste is 10 cm or less. If the thickness exceeds 10 cm, the interior can not be done at a NV of 95% or more.

If the reduced pressure condition during the drying process is higher than 10 Torr, residue from the solvent accumulates in large amounts and, as a result, a pinhole on the coated film may occur. Also, it becomes necessary to increase the drying temperature, so that the curing reaction proceeds, thereby the practical use may not become difficult.

It is necessary for the obtained dried product to have a NV of 95% or more. This is because, if the amount of residual solvent is large, it may cause a pinhole on the coated film.

It is necessary for the aforementioned dried product to have a density of 0.4 to 0.6 $g/cm^3$. This is because, if the density deviates from this range, the pulverising capability in the subsequent pulverizing process may decrease. For example, there occurs a problem of inferiority in the pulverizing efficiency, increase in the formation of non-pulverized products and coarse particles, and broadening particle distribution.

According to a method for making a powder coating relating to the present invention, it is possible to carry out color matching in a short time and also, to intend an efficient drying process, and to facilitate pulverizing.

The above, and other objects, features and advantages of the present invention will become apparent from the following description read in conjunction with the accompanying drawings, in which the reference numerals designate the same elements.

DETAILED DESCRIPTION OF THE PREFERRED EMBODIMENTS

Figure 1:
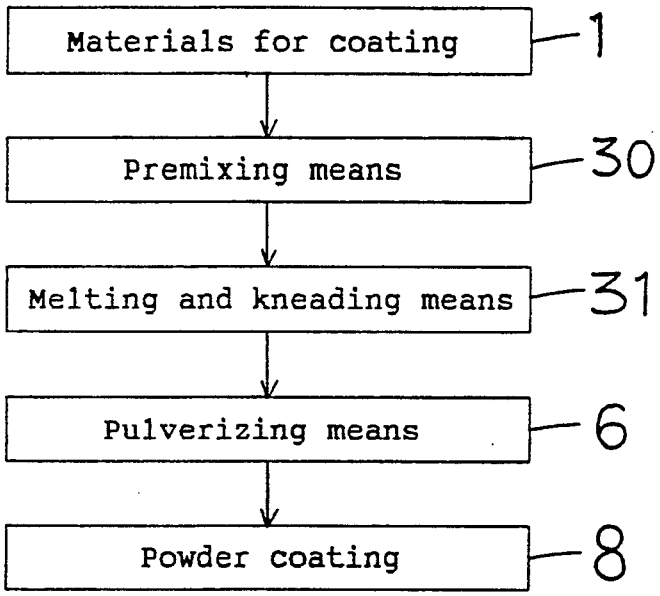
FIG. 1 is a flow diagram representing a preferred embodiment of a method for making a powder coating of the present invention.

FIG. 1 represents one example of a method for making a powder coating of this invention. A material for coating 1 is placed into a premixing means 30 and, after being mixed without a solvent, the kneading is carried out by the melting and kneading means 31. The mixture obtained is introduced to a pulverizing means 6 for pulverizing, whereby the powder coating 8 is obtained without classification.

Figure 5:
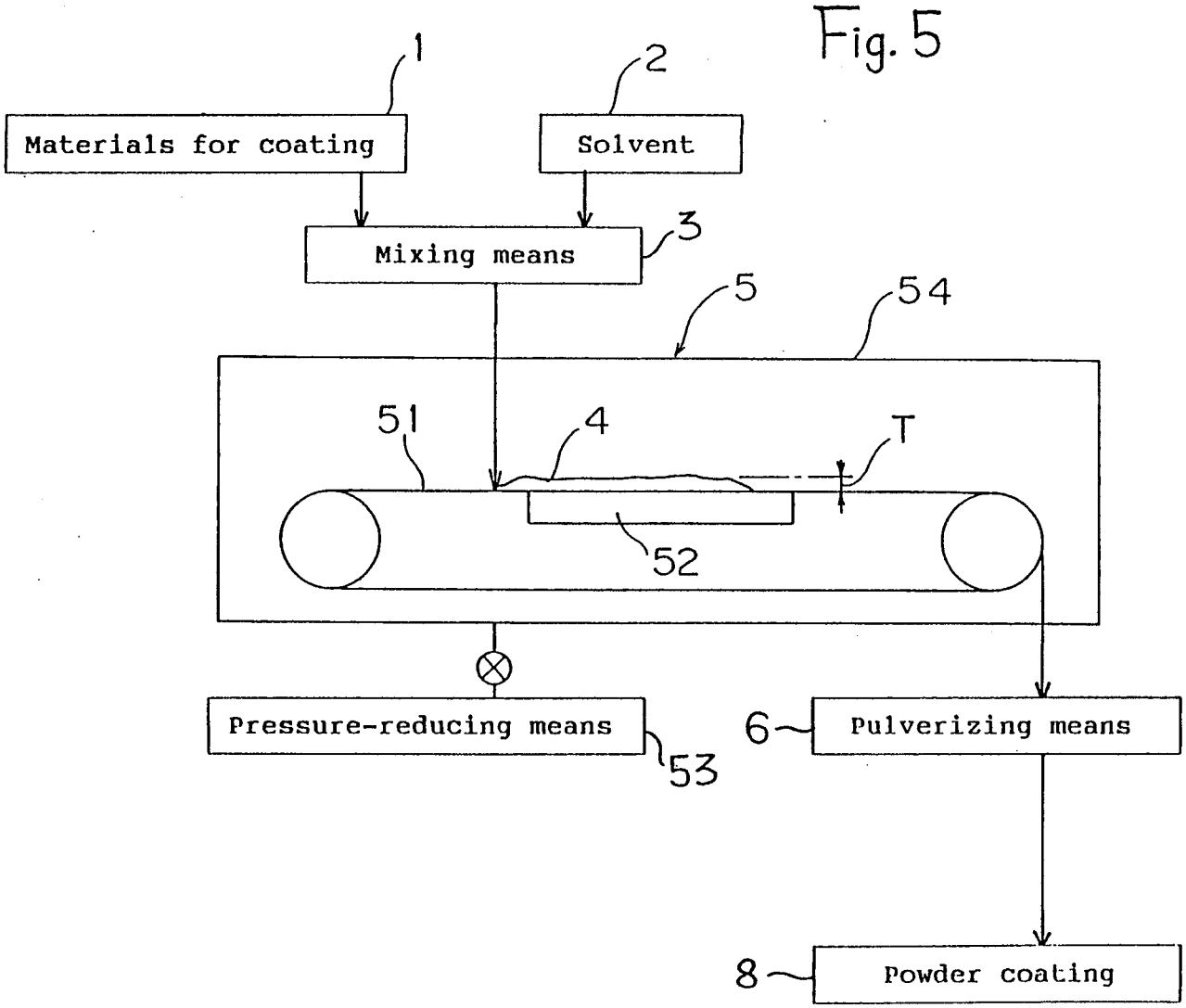
FIG. 5 is a flow diagram representing another example of a method for making a powder coating of the present invention.

FIG. 5 represents another example of a method for making a powder coating of this invention. The material for coating 1 and a solvent 2 are placed into a mixing means 3 to carry out mixing. This mixture, that is a dispersed paste, is introduced to a drying means 5 and heated and dried. The dried mixture is introduced to the pulverizing means 6 for pulverizing, whereby the powder coating 8 is obtained without classification.

The material for coating used in the present invention is a standard material for use in a powder coating and it is not especially limited. For example, one standard material is composed of a resin, a curing agent, a pigment (it is unnecessary in the case of a clear type coating), and other additives.

A solvent used in the case where the aforementioned material for coating so necessitates, requires no special properties; suitable solvents include xylene, (XL), toluene, methyl ethyl ketone (MEK), etc. The amount of a solvent is, for example, from 20 to 40% by weight against a total amount of the dispersed paste.

The mixing is carried out, for example, by premixing with a Henschel mixer etc. under a dried condition having no solvent and then, by melting and kneading by an extruder, etc. Conditions of the premixing and melting and kneading may be the same as those in a common procedure. The mixing is also carried out, for example, by a solution dispersion to obtain a dispersed paste. Preferred mixing means used here is, for example, a SG mill, a roll mill, ATTRITOR, etc. The mixing conditions may be similar to those in making a common paste-type coating. In case of mixing according to a wet type, drying is carried out.

Figure 2:
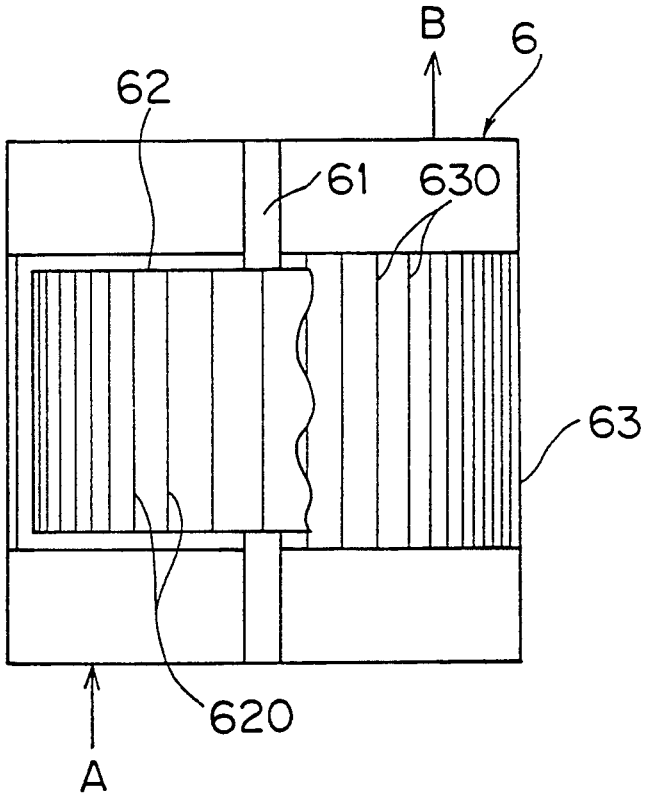
FIG. 2 is a schematic longitudinal section view representing one example of a pulverizing means using in the present invention.
Figure 3:
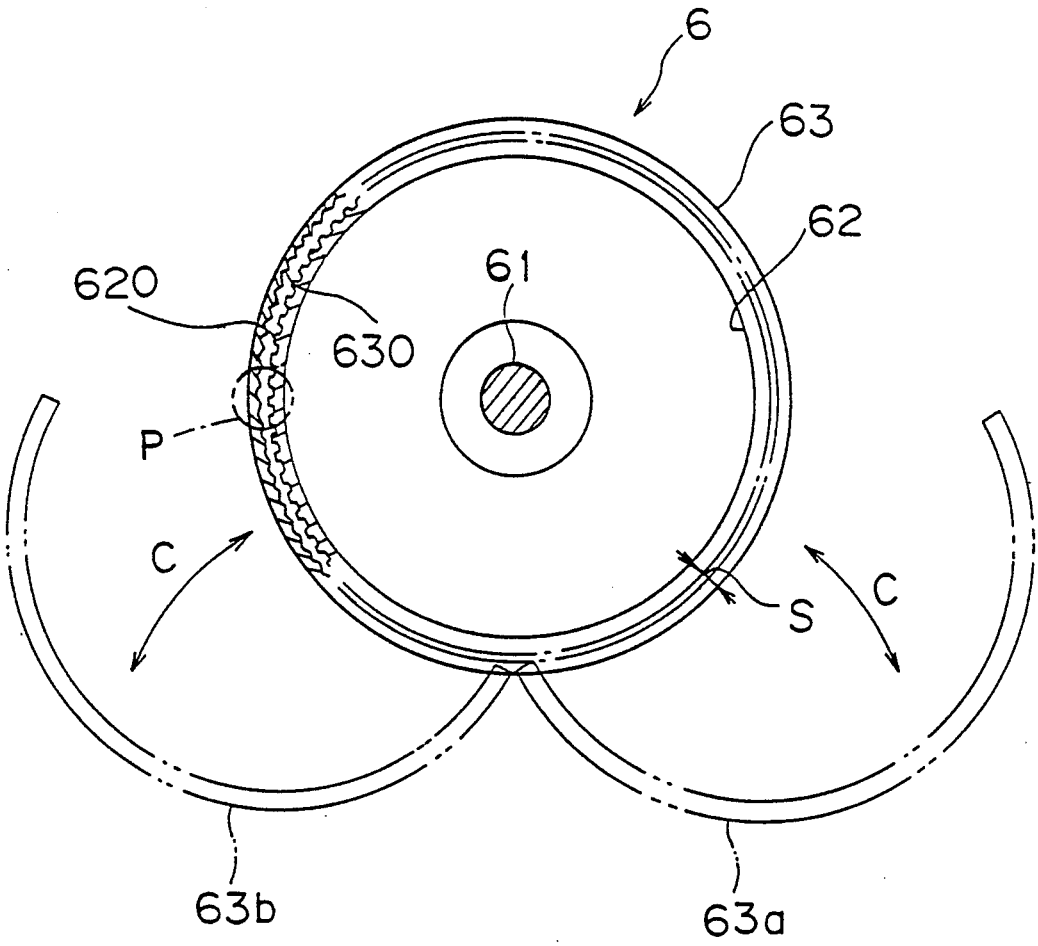
FIG. 3 is a schematic transversal-sectional view representing the example of a pulverizing means using in the present invention.
Figure 4:
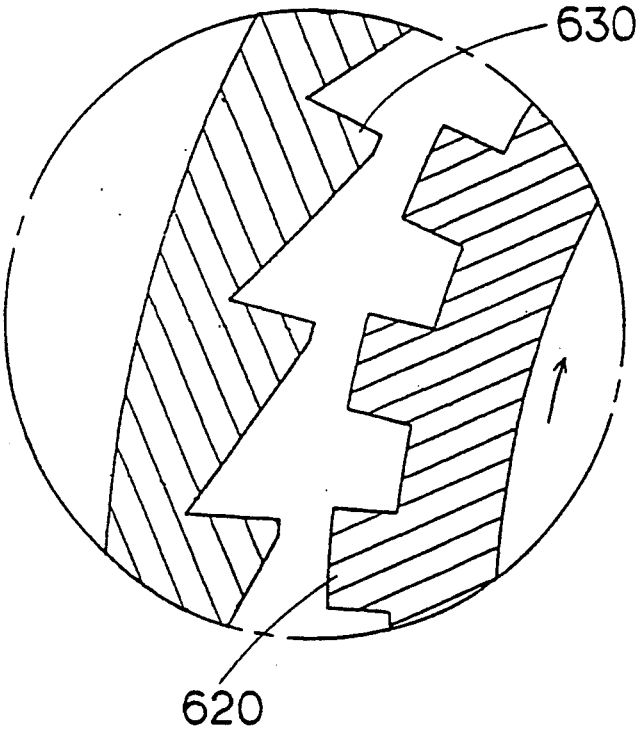
FIG. 4 is an enlarged view of the circled area marked P in FIG. 3.

According to the present invention, a solid mixture of materials for a coating is pulverized by a pulverizing method of an air current-mechanical system. This pulverizing method comprises introducing a mixture, which may have been previously subjected to either coarse crushing or coarse crushing and small crushing, to between a rotor and a stator having defined structures, and further pulverizing the mixture by rotating the rotor. As seen in FIGS. 2 to 4, the rotor 62 is supported so as to be capable of rotating about a rotating shaft 61 extending through the rotor's axis and is arranged with multiple convex teeth 620, which extend along the shaft and are lined up along the periphery. The 61 is a rotating shaft. The stator 63 has a cylindric type inner periphery rotor-opposite face arranged with a certain interspace S between this face and the rotor periphery and, on the inner periphery, there are arranged multiple convex teeth 630 extending in the direction of the shaft and are lined up along the circumference, and the stator is arranged in such a manner as to be capable of opening in order to expose the rotor periphery. For example, as shown by the two-dotted line in FIG. 3, the cylindric vessel of the stator 63 is lengthwise divided into two. The first half part 63*a* having a half circumference and the second half part 63*b* having another half circumference, and both of two half parts are made so as to open and close sideways as shown by the arrow C. The interspace S between the rotor 62 and the stator 63 is set, for example, at 1 mm or less and the rotor 62 is rotated at a velocity of 6000 to 15000 rpm. At this time, to prevent a change in quality and/or melting of a resin etc. as a result of temperature-increase due to friction etc., there may be provided a cooling means capable of maintaining an air current to transport the aforementioned mixture at a temperature equal to or lower than that in a certain range.

Here, the temperature equal to or lower than that in a certain range denotes, for example, a temperature lower by 5° C. or more than a glass transition temperature (Tg) of the mixture. If the temperature of an air current is higher that (Tg-5)°C., there is a possibility that pulverized products will melt again and either stick to each other due to the pulverization heat or attach themselves to the rotor and stator. If the temperature of an air current is in a range of (Tg-5)° to (Tg-10)°C., rounder particles are obtained. The mixture is, as seen by the arrow A, in FIG. 2 introduced between the rotor 62 and the stator 63 of a pulverizing means 6. The product pulverized exits pulverizing means 6 as seen by the arrow B. Further, in FIGS. 2 and 3, the convex lines 620 and 630 are shown with simplicity. In FIG. 2 there is shown the stator at a rear side obtained by sectioning a part of the rotor. In FIG. 4 is shown an enlarged view the circle P part of FIG. 3. If such a pulverizer is used, a powder coating is obtained without classification.

A known example of a pulverizing apparatus is, for example, described in Japanese Examined Patent Publication No. 61-36463. However, the apparatus is not limited as described.

In the present invention, in a case where mixing is carried out by a wet system, a dispersed paste obtained by the mixing may be treated according to the following. A solid portion concentration of the dispersed paste (hereinafter, referred to as "NV") is set in a range of 60 to 80% by weight. When set at a NV value in the range, there are various advantages, for example, such as a decreasing amount of solvents which is evaporated, increasing drying efficiency, and disappearance of attaching to a belt, etc.

In a case of mixing by the wet system, if necessary, the color match is adjusted. In this case, since the material for coating is a paste, a coated film is immediately made by coating the paste, so that the color match adjustment is carried out during a short time. In a case where a clear type powder coating is prepared, the adjustment can be omitted.

Next, a solvent is evaporated from the dispersed paste and drying is carried out. For example, the dispersed paste is set at a thickness T of 10 cm or less under a condition of one side-opening and heated for drying under a reduced pressure of 10 Torr or less. In order to carry out drying in such a manner, it is convenient to use, for example, such as generally called as a pressure reducing belt dryer or a dry tray set in a pressure-reducing room.

In FIG. 5, the drying means 5 is a pressure-reducing belt dryer. A conveyor belt 51 is set in the reduced pressure room 54 and arranged so as to be capable of moving by a roll. The pressure reducing room 54 is arranged so as to be capable of reducing the pressure to the desired pressure by a pressure reducing means 53. The dispersed paste 4 is dispersed on the belt 51 in a layer having a thickness T and dried by heat transfer and convection from the heating plate 52. A dried product is peeled off from the felt 51 by a scraper (not illustrated) etc. and transferred to the pulverizing means 6. The heating plate 52 is made, for example, in a double tube system and, in the inner tube, a heating medium such as warm water, steam, or the like is introduced in such a manner as to set at a specific heating temperature.

Figure 8:
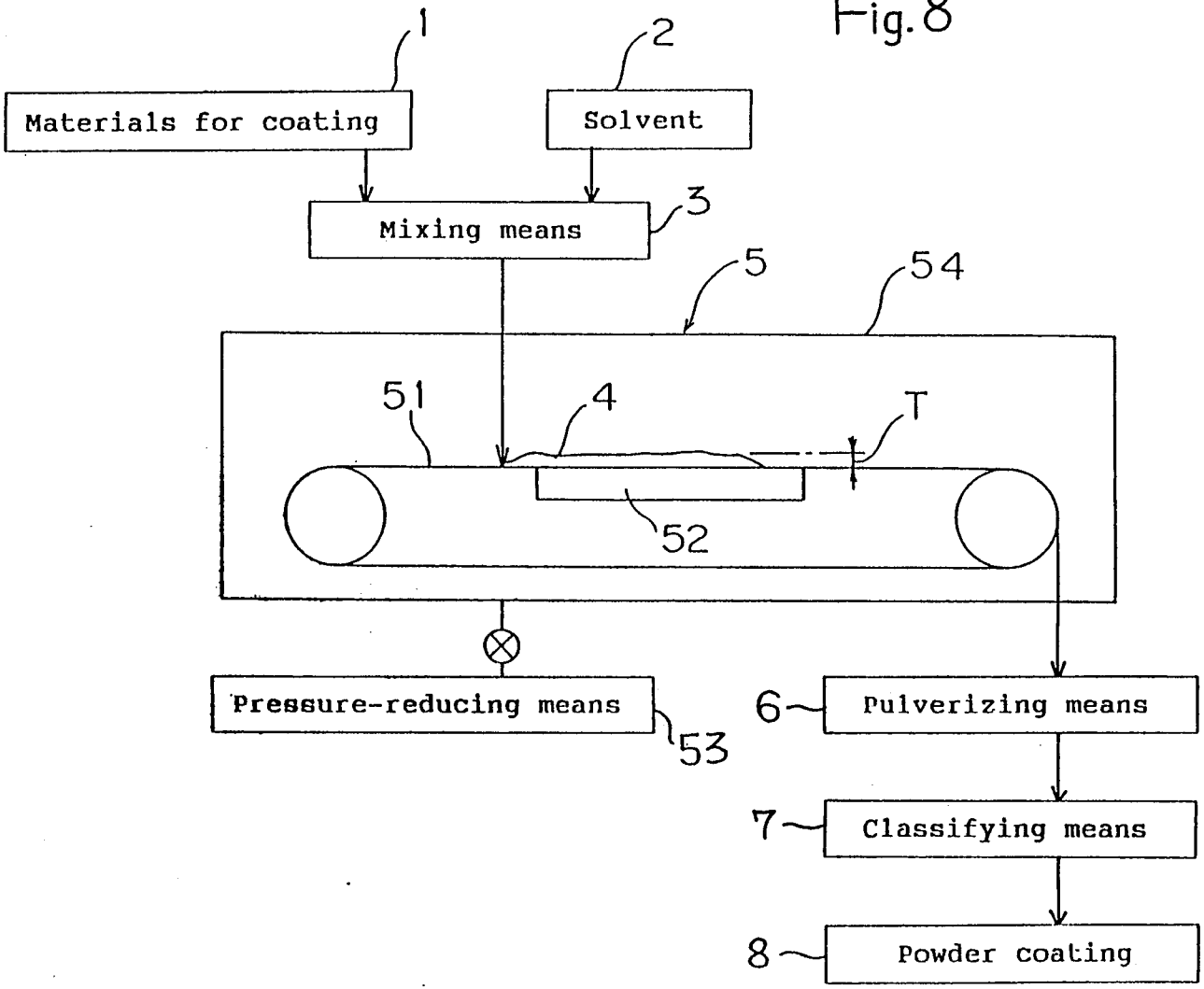
FIG. 8 is a schematic view representing a still further example of a method for making a powder coating of the present invention.

FIG. 8 represents another example of a method for making a powder coating of this invention. The coating material 1 and the solvent 2 are placed into the mixing means 3 for mixing. This mixture, that is a dispersed paste, is introduced to a drying means 5 for heat drying. The dried product is introduced to the pulverizing means 6 for pulverizing and then, to a classifying means 7 for classifying, whereby the powder coating 8 is obtained.

According to the present invention, pulverizing of the dried product is carried out by a conventional pulverizing method used in a common method for making a powder coating, for example, by a hammer mill method. After the pulverizing, if necessary, classifying by a vibrating sieve etc. and packing are carried out.

Further, pulverizing may be carried out by said hammer mill method etc., but the air current and mechanical type pulverizing method as above-mentioned may be used.

The dispersed paste may be spread into a film with a topside exposed on a surface material from which the dispersed paste is able to be peeled after drying. A preferable surface may be a belt made by immersing a fluororesin such as polytetrafluoroethylene resin (PTFE) etc. in a base material such as a glass cloth etc., but is not limited to this belt.

To obtain an atmosphere having a reduced pressure of 10 Torr or less, an usual pressure-reducing means and a pressure-reducing means being attached to a pressure reducing room or to a pressure reducing belt dryer may be used.

Although heat drying may be properly selected for heat transfer, warm wind, radiation, etc., radiation is preferred from the viewpoints of preventing a change in quality of the material and preventing it from becoming attached to the belt as result of the material surface being melted by heating. The heating temperature is not especially limited, but it may be set in the range from 70° to 110° C. or from 80° to 110° C. The heating time is not especially limited, but for example, it is during a time from 20 to 30 minutes or from 5 to 15 minutes. In a case where a belt dryer is used, it is possible to carry out the heat drying, continuously, so that there is an advantage in mass production. Also, in an use of the belt dryer, it is possible to set a plural zone where the heat drying is carried out, so that there is an advantage in mass production. Preferable examples of setting a plural zone for the heat drying are the first zone from 90° to 110° C. (the time to pass through is, for example from 6 to 8 minutes), the second zone is from 70° to 80° C. (the time to pass through is, for example, from 5 to 25 minutes), and the third zone is from 25° to 30° C. (the time to pass through is, for example, from 8 to 10 minutes).

By the heat drying, a dried product of high volume having a NV of 95% or more and a density of 0.4 to 0.6 g/cm$^3$ is obtained. This dried product is a porous board type, so that pulverizing is easy.

If the dispersed paste is dispersed as a layer and subjected to heat drying under reduced pressure, a dried product of high volume can be easily obtained. The dried product of high volume is easily pulverized in the subsequent pulverizing process.

If NV of the dispersed paste is lower than the aforementioned range, the time for drying becomes longer and also, because of low viscosity, there is a possibility of leaking out from both ends of the belt. If the NV is higher than the aforementioned range, the dried product of high volume cannot be made and also, because of high viscosity, there is a possibility that maintaining a stable supply is difficult and that a change in quality of the dried product occurs.

If thickness of the dispersed paste exceeds 10 cm when dried, it may be difficult to adjust the inside to condition of NV 95% or more.

If the pressure-reduced condition in the drying process is higher than 10 Torr, the residual solvent becomes large in quantity and may cause a pinhole on the coated film, or it becomes necessary to arrange for a higher drying temperature and, because of this high temperature, a hardening reaction proceeds and, thereby, the practical use may become difficult.

It is necessary that the obtained dried product has a NV of 95% or more. This is because, if the remains of a solvent is a lot, it may cause a pinhole on the coated film.

Also, it is necessary that the dried product has a density in the range of 0.4 to 0.6 g/cm$^3$. This is because, if the density deviates from this range, there is a problem that the efficiency of pulverizing may become inferior, occurrence of unpulverized products and coarse particles become large, and the particle size distribution becomes broad.

Hereinafter, practical examples and comparative examples of this invention are presented, but the invention is not limited to the undermentioned examples.

EXAMPLE A-1

| [Formulation of materials for coating] | |
|---|---|
| resin solid portion | 70 parts by weight |
| dodecanedioic acid | 11 parts by weight |
| titanium dioxide | 30 parts by weight |
| surface-conditioner | 0.5 parts by weight |
| benzoin | 0.5 parts by weight |

[Resin solid portion is obtained by using 25 parts by weight of styrene, 29.57 parts by weight of methyl methacrylate, 30.0 parts by weight of glycidyl methacrylate, 15.43 parts by weight of n-butyl methacrylate, and 2 parts by weight of azobisisobutyronitrile to carry out the solution polymerization and then, by heating under a reduced pressure. The surface-conditioner used was Acronal 4F (trade name), made by BASF Co., Ltd.]

The aforementioned materials for coating (no solvent) was subjected to melt kneading at 90° C. by using an extruder (made by BUSS AG.), then the product kneaded is coarsely crushed to pellets of about 1 cm, continuously introduced to the aforementioned pulverizer A (an air current and mechanical type pulverizer, a trade name "Kryptron" KTM-X type, made by Kawasaki Heavy Industries, LTD., was used) by an air current of 12° C. (2.5 Nm$^3$/minute), and pulverized to obtain a powder coating. The pulverizing conditions were 5 kg/hr in an amount of materials to be supplied (a coarsely-crushed product) and 12000 rpm in a rotating number of the rotor.

EXAMPLE A-2

The aforementioned materials for coating were mixed by a SG mill (a trade name "Neograin mill", made by Asada Iron Works Co., LTD.) in the presence of a solvent (40 parts by weight of xylene), whereby a dispersed paste was obtained. The dispersed paste obtained had a NV of 60% by weight. This dispersed paste was continuously supplied as the undermentioned, to carry out heat drying. That is, in a pressure reduced room of 10 Torr, the dispersed paste was continuously spewed out from a material-supplying nozzle onto a PTFE-immersed glass cloth belt so as to make a 10 cm thickness and the belt was transferred at a specific velocity under a condition of one side-opening to pass through the zone at 95° C. temperature during 7 minutes, the zone of 80° C. temperature during 15 minutes, and the zone of 30° C. temperature during 10 minutes in order for drying the paste, whereby a dried product was obtained by peeling-off by a scraper. The dried product obtained was of high volume such as shown by having a NV of 98% by weight and a density of 0.6 g/cm$^3$. A powder coating was obtained by pulverizing this dried product similarly to the case of Example A-1.

EXAMPLES A-3 and A-4

The procedures of Examples A-1 and A-2 were repeated except that such as shown in Table 1 were carried out, whereby powder coatings were obtained.

COMPARATIVE EXAMPLE A-1

A powder coating was obtained by pulverizing the kneaded product obtained from Example A-1 by a hammer mill (a trade name "Samplemill", K II-1 type, made by Fuji Paudaru Co., LTD.). Pulverizing conditions were an use of 6 pieces of hammers, a rotating number of 5000 rpm, and an amount 5 kg/hr of the supplying materials.

COMPARATIVE EXAMPLE A-2

The powder coating obtained from Comparative Example A-1 was sieved by a Tyler standard sieve to recover particles passing through a 150 mesh sieve, whereby a powder coating was obtained.

COMPARATIVE EXAMPLE A-3

A dried product obtained from Example A-2 was pulverized by a hammer mill similarly to the case of Comparative Example A-1.

COMPARATIVE EXAMPLE A-4

The powder coating obtained from Comparative Example A-3 was sieved by a Tyler standard sieve to recover particles passing through a 150 mesh sieve, whereby a powder coating was obtained.

Further, the mixtures obtained from the examples and comparative examples had Tg of about 70° C.

For each of the powder coatings obtained from the examples and comparative examples, the average particle diameter, particle size distribution, and particle shape were examined. The particle shape was examined by a scanning electron microscope and shown by the following standard.

Figure 7:
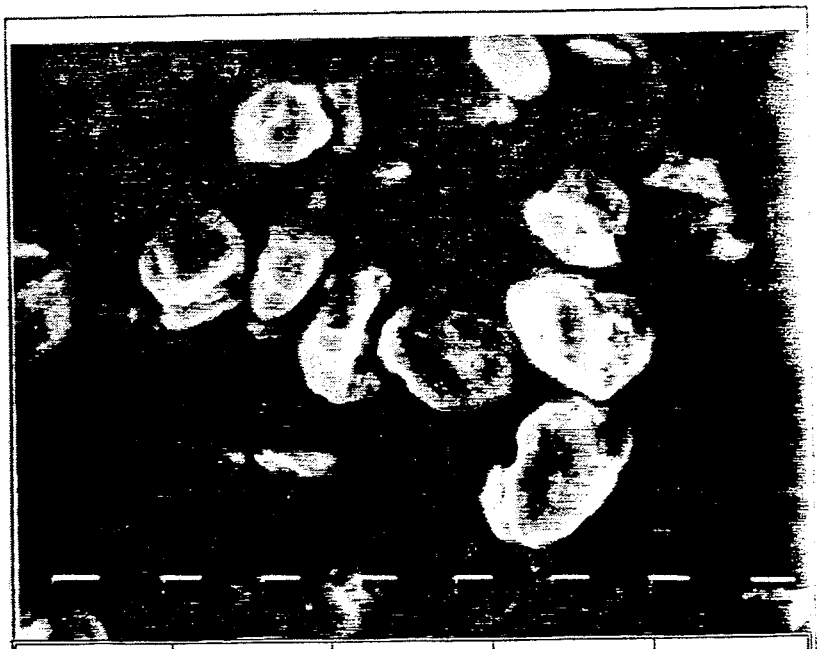
FIG. 7 is a photograph showing a particle structure and a photograph by a scanning electron microscope of a powder coating obtained from Examples A-4 and B-4.

Sphere shape: angleless and roundish (refer to FIG. 7)

Figure 6:
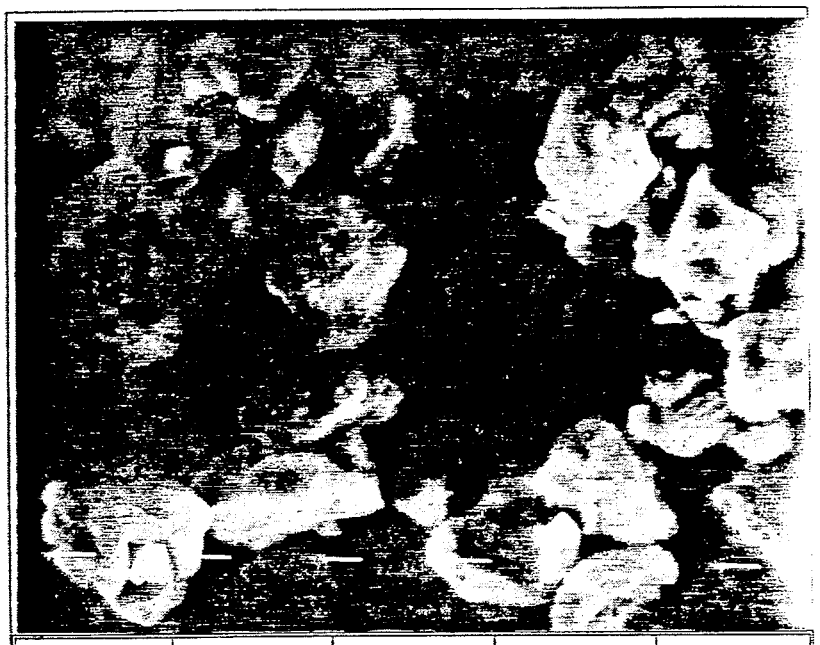
FIG. 6 is a photograph showing a particle structure and a photograph by a scanning electron microscope of a powder coating obtained from Examples A-2 and B-3.

Nonsphere shape: angular (refer to FIG. 6)

Each powder coating of the examples and comparative examples were coated by electrostatic painting for cold rolled carbon steel sheets (JIS-G3141) and baked at 140° C. for 30 minutes to make film having a thickness of 0.06 mm. The surface-smoothness of each coated film was shown by the presence or absence of uneven irregularities and the gloss.

The presence or absence of uneven irregularities was examined by NSIC (Image Clarity Method) and by the naked eye. As the NSIC value is larger, the uneven irregularities is less. The results by the naked eye were indicated by a circle ○ for the absence of uneven irregularities; a triangle Δ for the presence of a few uneven irregularities; a cross X for the presence of many uneven irregularities.

The gloss was examined by the 60° specular gloss of JIS-K 5400.

The results are shown in Table 2. Photographs by a scanning electron microscope of the powder coatings obtained from Examples A-2 and A-4 were shown in FIGS. 6 and 7.

TABLE 1

| | Production of solid mixture of coating materials | Pulverizing | | | Classification |
|---|---|---|---|---|---|
| | | Pulverizing apparatus | Air current temperature (°C.) | Air current velocity ($m^3$/minute) | |
| Example A-1 | Melting and kneading | Kryptron | 12 | 2.5 | No |
| Example A-2 | Mixing solution followed by heat drying under reduced pressure | Kryptron | 12 | 2.5 | No |
| Example A-3 | Melting and kneading | Kryptron | 65 | 2.0 | No |
| Example A-4 | Mixing solution followed by heat drying under reduced pressure | Kryptron | 65 | 2.0 | No |
| Comparative Example A-1 | Melting and kneading | | Hammer mill | | No |
| Comparative Example A-2 | Melting and kneading | | Hammer mill | | Yes |
| Comparative Example A-3 | Mixing solution followed by heat drying under reduced pressure | | Hammer mill | | No |
| Comparative Example A-4 | Mixing solution followed by heat drying under reduced pressure | | Hammer mill | | Yes |

TABLE 2

| | Properties of powder coating | | | Properties of coated film | | |
|---|---|---|---|---|---|---|
| | Average particle diameter (μm) | Particle size distribution range (μm) | Particle shape | Presence or absence of uneven irregularities NSIC | Presence or absence of uneven irregularities By naked eye | Gloss 60° gloss |
| Example A-1 | 10 | 5 to 25 | Nonspherical | 24 | ○ | 95 |
| Example A-2 | 10 | 5 to 20 | Nonspherical | 23 | ○ | 92 |
| Example A-3 | 10 | 5 to 20 | Spherical | 24 | ○ | 90 |
| Example A-4 | 10 | 5 to 20 | Spherical | 20 | ○ | 90 |
| Comparative Example A-1 | 45 | 8 to 200 | Nonspherical | 5 | x | 60 |
| Comparative Example A-2 | 30 | 8 to 100 | Nonspherical | 9 | Δ | 85 |
| Comparative Example A-3 | 35 | 5 to 150 | Nonspherical | 7 | x | 80 |
| Comparative Example A-4 | 30 | 5 to 100 | Nonspherical | 9 | Δ | 89 |

As seen in Tables 1 and 2, the results show properties of the coated films increased by the finer pulverizing. When the air current temperature in pulverizing is lower than (Tg-10)°C., angular coating particles as seen in FIG. 6 are obtained and, if the temperature is set in a range of (Tg-5)° to (Tg-10)°C., a powder coating of rounder particles is obtained.

In examples A-1 to A-4, after the pulverizing was continuously carried out for 24 hours, when the powder coating attached itself to the pulverizing apparatus, it was checked, and it was found that some amounts attached themselves to the outlet of the pulverized product (part B in FIG. 2) and at the convex lines on the rotor and stator (parts 620 and 630 in FIGS. 3 and 4), but this attached powder coating can be taken off by a wash cloth and was completely removed within about 10 minutes. By contrast, the hammer mill used in the comparative examples, when the attached powder coating was checked after the pulverizing was continuously carried out for 5 hours. It was found that some amounts of the powder coating melted and attached itself to the whole hammer and the inside housing. This required the complete removal of the attached powder coating, which took 2 hours using an organic solvent (xylene or MEK).

EXAMPLE B-1

A dispersed paste was obtained by mixing the undermentioned coating materials by a SG mill (trade name "Neograin mill", made by Asada Iron Works Co., Ltd.) in the presence of the undermentioned solvent. The obtained dispersed paste had a NV of 60%. This paste was continuously supplied in the following manner, and heat drying process was carried out. That is, in the pressure-reduced room of 10 Torr, the dispersed paste was continuously spewed out from a material-supplying nozzle onto a PTFE-immersed glass cloth belt in such a manner as to make a 10 cm thickness. The belt travels at a specific velocity to dry the paste under a one side-opened condition, passing through the zone of 95° C. during 7 minutes, the zone of 80° C. during 15 minutes, and the zone of 30° C. during 10 minutes in this order, and thus, a dried product is obtained by peeling it off the belt by using a scraper. The dried product is of high volume such as shown in having a NV of 98% and a density of 0.6 g/cm$^3$. This dried product was coarsely crushed into a pellet type of about 1 cm in size. It is then, continuously introduced by an air current (2.5 Nm$^3$/minute) with a temperature of 12° C. into an air current and mechanical type pulverizer (a trade name "Krypton", KTM-X model), made by Kawasaki Heavy Industries, LTD., where it is pulverized to obtain a powder coating. The pulverizing conditions were 5 kg/hr in an amount of materials to be supplied (a coarsely-crushed product) and 6000 rpm in a rotating number of the rotor.

| [Formulation of materials for coating] | |
|---|---|
| resin solid portion | 70 parts by weight |
| dodecanedioic acid | 11 parts by weight |
| titanium dioxide | 30 parts by weight |
| surface-conditioner | 0.5 parts by weight |
| benzoin | 0.5 parts by weight |
| [Solvent] | 40 parts by weight |
| xylene | |

[Resin solid portion was obtained by using 25 parts by weight of styrene, 29.57 parts by weight of methyl methacrylate, 30.0 parts by weight of glycidyl methacrylate, 15.43 parts by weight of n-butyl methacrylate, and 2 parts by weight of azobisisobutyronitrile to carry out solution polymerization and then, by heating under a reduced pressure. The surface-conditioner used was Acronal 4F (trade name), made by BASF Co., Ltd.].

EXAMPLES B-2 to B-6

The procedure of Example B-1 was repeated except that the alteration shown in Table 3 was carried out, whereby powder coatings were obtained. But, in Examples B-3 and B-4, rotating numbers of the rotor were 12000 rpm.

EXAMPLE B-7

A dried product obtained from Example B-1 was pulverized by a hammer mill (a trade name "Sample Mill" K II-1 model, made by Fuji Paudaru Co., LTD.). The pulverizing conditions was the use of 6 hammers, a rotating number of 5000 rpm, and an amount 5 kg/hr of the supplying materials. The pulverized product was sieved by a Tyler standard sieve to recover particles passing through a 150 mesh sieve, whereby the powder coating was obtained.

Further, Tg of the dried products in the examples were about 70° C.

COMPARATIVE EXAMPLE B-1

The procedure of Example B-1 was repeated to obtain a powder coating except that NV of the dispersed paste was altered to 50%. However, the NV of a dried product obtained was 82%.

COMPARATIVE EXAMPLE B-2

The procedure of Example B-1 was repeated to obtain a powder coating except that NV of the dispersed paste was altered to 90%. However, the density of a dispersed product obtained was too thick to supply the product to a drying apparatus.

COMPARATIVE EXAMPLE B-3

The procedure of Example B-1 was repeated to obtain a powder coating except that the surrounding pressure during drying is adjusted to 15 Torr. However, the surrounding pressure during drying was too high to obtain a dried product having a NV of 95% or more.

COMPARATIVE EXAMPLE B-4

The procedure of Example B-1 was repeated to obtain a powder coating except that NV of the dried product was adjusted to 90%. However, the NV of the dried product was so low causing pinholes in the coated film.

COMPARATIVE EXAMPLE B-5

The above-described coating materials were premixed without using a solvent under conditions at a rotating rate of 1000 rpm by a Henshel mixer for 30 minutes, and subjected to melting and kneading at 90° C. by using an extruder (made by Buss AG.). The processes after pulverizing were carried out similarly to those in Example B-2, whereby a powder coating was obtained.

COMPARATIVE EXAMPLE B-6

A powder coating was obtained by pulverizing the melt kneaded product prepared from Comparative Example B-5, as carried out in example B-1.

In Table 3 are shown the conditions of drying and pulverizing.

In the above-described Examples B-1 to B-7, the color match was carried out in each case with a variety of pigments. Here, a dispersed paste was coated on a tinplate so as to make a thickness of 0.75 mm, dried at 140° C. for 30 minutes, and hardened to make a coated film, and thus, confirming the color. In contrast, when the pigments were altered in Comparative Examples B-5 and B-6, it was necessary to produce the powder coating, to coat this and bake it, thereby making a coated film, and confirming the color.

For each of the powder coatings obtained from the examples and comparative examples, the average particle diameter, particle size distribution, and particle shape were examined. The particle shapes were examined by a scanning electron microscope and shown by the following standard.

Spherical shape: angleless and round (refer to FIG. 7)

Nonspherical shape: angular (refer to FIG. 6)

Each powder coating of the examples and comparative examples were coated by electrostatic painting for cold rolled carbon steel sheets (JIS-G3141) and baked at 140° C. for 30 minutes to make a coated film having a thickness of 0.06 mm. The surface-smoothness of each coated film was shown by the presence or absence of uneven irregularities and the gloss.

The results are shown in Table 4. Photographs by a scanning electron microscope of the powder coatings obtained from Examples B-3 and B-4 were shown in FIGS. 6 and 7.

TABLE 3

| | Drying | | | | | Pulverizing | | |
|---|---|---|---|---|---|---|---|---|
| | NV of dispersed paste (%) | Thickness (cm) | Surrounding pressure (Torr) | NV of dried product | Density of dried product (g/cm$^3$) | Pulverizing apparatus | Air current temperature (°C.) | Air current velocity (m$^3$/minute) |
| Example B-1 | 60 | 10 | 10 | 95 | 0.5 | Kryptron | 12 | 2.5 |
| Example B-2 | 60 | 10 | 10 | 95 | 0.5 | Kryptron | 65 | 2.0 |
| Example B-3 | 60 | 10 | 10 | 95 | 0.5 | kryptron | 12 | 2.5 |
| Example B-4 | 60 | 10 | 10 | 95 | 0.5 | Kryptron | 65 | 2.0 |
| Example B-5 | 70 | 10 | 5 | 98 | 0.4 | Kryptron | 12 | 2.5 |
| Example B-6 | 80 | 5 | 10 | 98 | 0.6 | Kryptron | 12 | 2.5 |
| Example B-7 | 60 | 10 | 10 | 95 | 0.5 | Hammer mill | 12 | 2.5 |

TABLE 4

| | Properties of powder coating | | | Properties of coated film | | |
|---|---|---|---|---|---|---|
| | | | | Presence or absence of uneven irregularities | | Gloss |
| | Average particle diameter (μm) | Particle size distribution range (μm) | Particle shape | NSIC | By naked eye | 60° gloss |
| Example B-1 | 23.3 | 18 to 51 | Nonspherical | 11.2 | ○ | 89 |
| Example B-2 | 29.2 | 10 to 60 | Spherical | 15.6 | ○ | 89 |
| Example B-3 | 10.0 | 5 to 20 | Nonspherical | 23.0 | ○ | 92 |
| Example B-4 | 10.0 | 5 to 20 | Spherical | 20.0 | ○ | 90 |
| Example B-5 | 35.0 | 10 to 90 | Nonspherical | 18.0 | ○ | 89 |
| Example B-6 | 35.0 | 10 to 90 | Nonspherical | 16.0 | ○ | 87 |
| Example B-7 | 35.0 | 12 to 90 | Nonspherical | 8.4 | ○ | 87 |

As seen in Tables 3 and 4, a coated film not having irregularities, but having excellent gloss was obtained. If the air current temperature during pulverizing is lower than (Tg-10)°C., angular coating particles are obtained as seen in FIG. 6 and, if the temperature is in a range of (Tg-5)° to (Tg-10)°C., round powder coating is obtained as seen in FIG. 7. The pulverizer used in Examples B-1 to B-6 showed attaching less than that used in Example B-7, and the removal of these attaching was easy.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for making a powder coating comprising:

mixing coating materials in the presence of a solvent to form a paste;

dispersing said paste into a film;

drying said paste by heating of said film while exposing one side of said film to an atmosphere having a reduced pressure;

said drying continuing until said paste is transformed into a solid mixture;

introducing said solid mixture between a rotor and a stator;

said rotor being rotatably mounted about a shaft center and having teeth along a periphery of said rotor;

said stator being mounted about said rotor and having an inner periphery with teeth and said stator being separated from said rotor;

said stator having a first position effective for encompassing said rotor and a second position effective for exposing said rotor;

pulverizing said mixture by rotating said rotor to produce a powder coating; and supplying an air current having a temperature of (Tg-5)°C. or less between the rotor and stator during said pulverizing, in which Tg is a glass transition temperature of the mixture, to prevent the mixture from melting.

2. A method for making a powder coating comprising:

mixing coating materials in the presence of a solvent to form a dispersed paste having a solid portion concentration of 60 to 80% by weight;

dispersing said paste into a film;

drying said paste by heating of said film while exposing one side of said film to an atmosphere having a pressure of 10 Torr or less;

said drying effective to transform said dispersed paste into a solid mixture having a solid portion concentration of 95% or more by weight and a density of 0.4 to 0.6 g/cm$^3$;

introducing said solid mixture between a rotor and a stator;

said rotor being rotatably mounted about a shaft center and having teeth along a periphery of said rotor;

said stator being mounted about said rotor and having an inner periphery with teeth and separated from said rotor;

said stator having a first position effective for encompassing said rotor and a second position effective for exposing said rotor;

pulverizing said mixture by rotating said rotor to produce a powder coating; and supplying an air current having a temperature of (Tg-5)°C. or less between the rotor and stator during said pulverizing, in which Tg is a glass transition temperature of the mixture, to prevent the mixture from melting.

3. A method for making a powder coating comprising:

introducing a solid mixture of coating materials between a rotor and a stator;

said rotor being rotatably mounted about a shaft center and having teeth along a periphery of said rotor;

said stator being mounted about said rotor and having an inner periphery with teeth and separated from said rotor;

said stator having a first position effective for encompassing said rotor and a second position effective for exposing said rotor;

pulverizing said mixture by rotating said rotor to produce a powder coating; and supplying an air current, having a temperature in a range of (Tg-5)°C. to (Tg-10)°C., between the rotor and stator during said pulverizing, in which Tg is a glass transition temperature of the mixture, to prevent the mixture from melting.

4. The method of claim 3, wherein said solid mixture is made by melting and mixing said coating materials.

5. A method for making a powder coating comprising:

mixing coating materials in the presence of a solvent to form a dispersed paste;

dispersing said dispersed paste into a film upon a base surface, said film having a first and second side wherein said first side is in contact with said base surface and said second side is exposed to an atmosphere;

drying said film by heating said first side while exposing said second side to an atmosphere of 10 Torr or less to form a dried product having a solid portion concentration of at least 95% by weight and a density of 0.4 to 0.6 g/cm$^3$; and pulverizing the dried product said dispersed paste having a solid portion concentration of from 60 to 80% by weight.

6. The method of claim 5, wherein said pulverizing further comprises;

introducing said dried product between a rotor and a stator;

said rotor being rotatably mounted about a shaft center and having teeth along a periphery of said rotor;

said stator being mounted about said rotor and having an inner periphery with teeth and separated from said rotor;

said stator having a first position effective for encompassing said rotor and a second position effective for exposing said rotor; and pulverizing said dried product by rotating said rotor.

7. A method for making a powder coating, comprising:

mixing coating materials in the presence of a solvent to form a dispersed paste;

said dispersed paste having a solid portion concentration of from 60 to 80% by weight;

inserting said paste into a drying chamber;

dispersing said dispersed paste into a film upon a movable surface, said film having a first and second side wherein said first side is in contact with said surface, and said second side is exposed to an atmosphere;

drying said film in said drying chamber by moving said surface over a heating plate for heating said first side while exposing said second side to said atmosphere having a pressure of 10 Torr or less to form a dried product having a solid portion concentration of at least 95% by weight and a density of 0.4 to 0.6 g/cm$^3$;

introducing said dried product between a rotor and a stator;

said rotor being rotatably mounted about a shaft center and having teeth along a periphery of said rotor;

said stator being mounted about said rotor and having an inner periphery with teeth and separated from said rotor;

said stator having a first position effective for encompassing said rotor and a second position effective for exposing said rotor;

pulverizing said dried product by rotating said rotor; and supplying an air current having a temperature of (Tg-5)°C. or less, in which Tg is a glass transition temperature of said dried product, between the rotor and stator during aid pulverizing to prevent said dried product from melting.

8. The method of claim 7, wherein:

said temperature of said air current is at least (Tg-10).

* * * * *